US009444198B2

(12) United States Patent
Sunaga et al.

(10) Patent No.: US 9,444,198 B2
(45) Date of Patent: Sep. 13, 2016

(54) COMMUNICATION MODULE AND COMMUNICATION MODULE CONNECTOR

(71) Applicant: Hitachi Metals, Ltd., Minato-ku, Tokyo (JP)

(72) Inventors: Yoshinori Sunaga, Hitachinaka (JP); Kinya Yamazaki, Hitachi (JP); Yoshiaki Ishigami, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 14/600,694

(22) Filed: Jan. 20, 2015

(65) Prior Publication Data

US 2015/0255935 A1 Sep. 10, 2015

(30) Foreign Application Priority Data

Mar. 4, 2014 (JP) ..... 2014-041723
Mar. 17, 2014 (JP) ..... 2014-054057

(51) Int. Cl.
*H01R 24/00* (2011.01)
*H01R 24/60* (2011.01)
*H01R 13/631* (2006.01)
*H01R 13/6471* (2011.01)

(52) U.S. Cl.
CPC ..... *H01R 24/60* (2013.01); *H01R 13/631* (2013.01); *H01R 13/6471* (2013.01)

(58) Field of Classification Search
CPC ..... H01R 27/02
USPC ..... 439/676, 660, 626
See application file for complete search history.

(56) References Cited

U.S. PATENT DOCUMENTS 3,706,065 A * 12/1972 Knitter ..... H05K 3/3405 439/59
4,715,820 A * 12/1987 Andrews, Jr. ..... H01R 23/68 439/59
4,869,672 A * 9/1989 Andrews, Jr. ..... H01R 12/721 439/60
4,941,830 A * 7/1990 Tkazyik ..... H05K 1/117 439/59
5,496,180 A * 3/1996 Fabian ..... H01R 4/028 439/60
5,902,136 A * 5/1999 Lemke ..... H01R 43/24 439/660
6,048,230 A * 4/2000 Kikuchi ..... H01R 13/11 439/668

(Continued)

FOREIGN PATENT DOCUMENTS

JP H10-208800 A 8/1998
JP 2009-152144 A 7/2009

*Primary Examiner* — Tulsidas C Patel
*Assistant Examiner* — Peter G Leigh
(74) *Attorney, Agent, or Firm* — Crowell & Moring LLP

(57) ABSTRACT

A connector includes a plug connector and a receptacle connector. The plug connector has an insertion convex portion including: an end surface; outer side surfaces facing in parallel to each other across the end surface; and a first tapered surface connecting each outer side surface and the end surface. The receptacle connector has an insertion concave portion including: an insertion port; inner side surfaces facing in parallel to each other across the insertion port; and a second tapered surface connecting each inner side surface and an edge of the insertion port. The outer side surfaces of the insertion convex portion have first connection terminals arranged, the inner side surfaces of the insertion concave portion have second connection terminals arranged in contact with the first contact terminals, and the first tapered surface has a width twice as large as a width of the second tapered surface or larger.

10 Claims, 7 Drawing Sheets

(56) References Cited

U.S. PATENT DOCUMENTS 6,193,561 B1 * 2/2001 Harting ..... H01R 13/11 439/682
6,881,100 B2 * 4/2005 Barry ..... H01R 12/716 439/701
7,381,061 B2 * 6/2008 Hung ..... H01R 13/112 439/66
7,462,040 B1 * 12/2008 Takada ..... H01R 13/193 439/637
7,806,698 B2 * 10/2010 Regnier ..... H01R 13/26 439/37
7,922,495 B2 * 4/2011 Masuda ..... H01R 12/87 439/59
2010/0178809 A1 * 7/2010 Tsai ..... H01R 12/721 439/660
2013/0108224 A1 * 5/2013 Ishigami ..... G02B 6/4284 385/89

* cited by examiner

COMMUNICATION MODULE AND COMMUNICATION MODULE CONNECTOR

CROSS-REFERENCE TO RELATED APPLICATION

The present application claims priority from Japanese Patent Applications No. 2014-041723 filed on Mar. 4, 2014, and No. 2014-054057 filed on Mar. 17, 2014, the content of which is hereby incorporated by reference into this application.

TECHNICAL FIELD OF THE INVENTION

The present invention relates to a communication module and a communication module connector.

BACKGROUND OF THE INVENTION

In a server, a network device, and others, a semiconductor chip (IC chip) and a plurality of communication modules are mounted on a substrate generally called a motherboard. Here, the throughput of the semiconductor chip (IC chip) has been rapidly improved with line thinning of a semiconductor manufacturing process. With the improvement in the throughput of the semiconductor chip, increase in speed of digital signals inputted to and outputted from the semiconductor chip has been advanced year after year. That is, increase in the speed of the digital signals exchanged between the semiconductor chip and the communication module has been advanced year after year. It has been expected that the speed of digital signals inputted to and outputted from a next-generation semiconductor chip and communication module becomes 25 Gbit/sec, and expected that the speed of digital signals inputted to and outputted from a next-next-generation semiconductor chip and communication module becomes 50 Gbit/sec.

However, high-speed digital signals have a large transmission loss in electrical transmission. In other words, high-speed digital signals have severe signal degradation during transmission. For example, in the case of the high-speed digital signals of 25 Gbit/sec, a loss of about 0.8 dB/cm occurs on electric wiring formed on a general printed board. Even on electric wiring formed on a sophisticated printed board for high-speed signals, a loss of about 0.4 dB/cm occurs.

SUMMARY OF THE INVENTION

Under these circumstances as described above, it is required to mount a lot of communication modules with high density on a portion in vicinity of the semiconductor chip.

However, a LGA (Land Grid Array) structure that has been conventionally used as a communication module mount structure has high cost and is inconvenient (that is, it is difficult to attach/detach the communication module).

An object of the present invention is to provide a small-sized and convenient communication module connector for achieving the high-density mounting of communication modules, and provide a communication module with the connector.

In one aspect of the present invention, a communication module connector is configured of a plug connector and a receptacle connector into which the plug connector is inserted. The plug connector has an insertion convex portion including: an end surface; two outer side surfaces facing in parallel to each other across the end surface; and a first tapered surface connecting each of the outer side surfaces and the end surface. The receptacle connector has an insertion concave portion into which the insertion convex portion is inserted, the insertion concave portion including: an insertion port; two inner side surfaces facing in parallel to each other across the insertion port; and a second tapered surface connecting each of the inner side surfaces and an edge of the insertion port. Each of the outer side surfaces of the insertion convex portion has a plurality of first connection terminals arranged in parallel to each other along longitudinal directions of these outer side surfaces, and each of the inner side surfaces of the insertion concave portion has a plurality of second connection terminals arranged in parallel to each other in contact with the first connection terminals. And, the first tapered surface has a width which is twice as large as a width of the second tapered surface or larger.

In another aspect of the present invention, a communication module connector is configured of a plug connector and a receptacle connector into which the plug connector is inserted. The plug connector has an insertion convex portion, and the receptacle connector has an insertion concave portion into which the insertion convex portion is inserted. Two outer side surfaces of the insertion convex portion which are in parallel to each other have a plurality of first connection terminals arranged in parallel to each other along longitudinal directions of these outer side surfaces, and two inner side surfaces of the insertion concave portion which are in parallel to each other have a plurality of second connection terminals arranged in parallel to each other in contact with the first connection terminals. Each of the first connection terminals and the second connection terminals extends along an inserting direction of the insertion convex portion into the insertion concave portion. An upper-side end portion of the second connection terminal in the inserting direction is positioned higher than any other part of the second connection terminal in the same direction, and the second connection terminal does not have a part positioned at the same height in the inserting direction. In a state in which the plug connector and the receptacle connector are connected to each other, a direct distance along the inserting direction from a lower-side end portion of the second connection terminal in the inserting direction to an upper-side end portion of the first connection terminal in the inserting direction in contact with the second connection terminal is 6.0 mm or smaller.

In still another aspect of the present invention, a communication module includes a plug connector to be connected to a receptacle connector. The plug connector has an insertion convex portion to be inserted into an insertion concave portion provided to the receptacle connector, the insertion convex portion including: an end surface; two outer side surfaces facing in parallel to each other across the end surface; and a first tapered surface connecting each of the outer side surfaces and the end surface. The insertion concave portion of the receptacle connector includes: an insertion port into which the insertion convex portion is inserted; two inner side surfaces facing in parallel to each other across the insertion port; and a second tapered surface connecting each of the inner side surfaces and an edge of the insertion port. A plurality of first connection terminals to be connected to a plurality of second connection terminals arranged on the inner side surfaces of the insertion concave portion are arranged on the outer side surfaces of the insertion convex portion, respectively, and the first tapered surface has a width twice as large as a width of the second tapered surface or larger.

In still another aspect of the present invention, a communication module includes a plug connector to be connected to a receptacle connector. The plug connector has an insertion convex portion to be inserted into an insertion concave portion provided to the receptacle connector. A plurality of first connection terminals to be connected to a plurality of second connection terminals arranged on two inner side surfaces of the insertion concave portion which are in parallel to each other are arranged on two outer side surfaces of the insertion convex portion which are in parallel to each other. Each of the first connection terminals and the second connection terminals extends along a direction in which the insertion convex portion is inserted into the insertion concave portion. An upper-side end portion of the second connection terminal in the inserting direction is positioned higher than any other part of the second connection terminal in the same direction, and the second connection terminal does not have a part positioned at the same height in the inserting direction. In a state in which the plug connecter is connected the receptacle connector, a direct distance from a lower-side end portion of the second connection terminal in the inserting direction to an upper-side end portion of the first connection terminal in the inserting direction in contact with the second connection terminal is 6.0 mm or smaller.

According to the present invention, a small-sized and convenient communication module connector for achieving the high-density mounting of a communication module and a communication module with the connector are achieved.

BRIEF DESCRIPTIONS OF THE DRAWINGS

DESCRIPTIONS OF THE PREFERRED EMBODIMENTS

Figure 1:
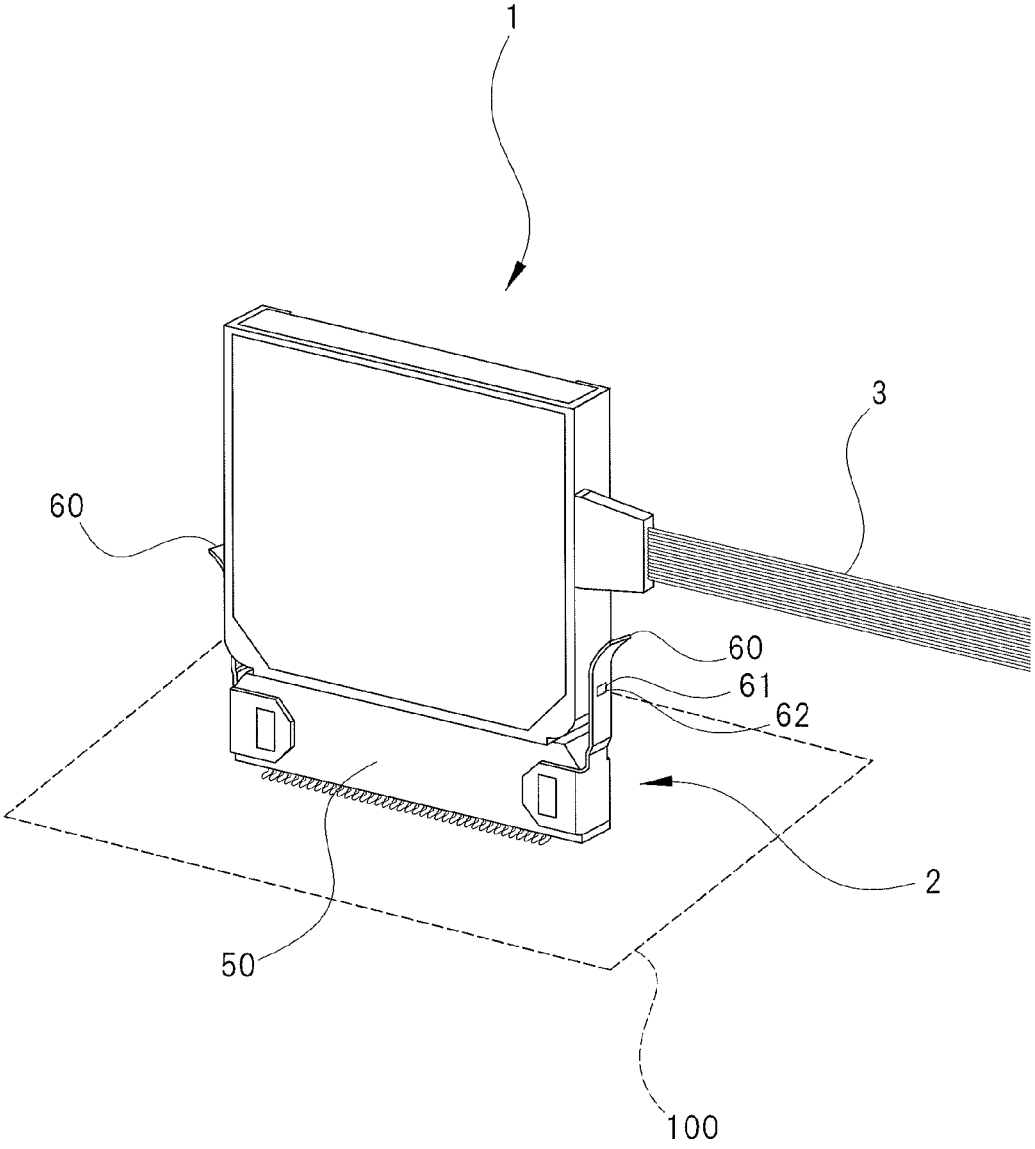
FIG. 1 is a perspective view showing an example of a communication module connected to a motherboard via a connector to which the present invention is applied.

Hereinafter, an example of embodiments of the present invention will be described in detail with reference to the drawings. A communication module 1 shown in FIG. 1 is connected to a substrate (motherboard 100) via a communication module connector 2. Although not shown, a semiconductor chip is mounted on the motherboard 100, and the communication module 1 connected to the motherboard 100 is connected to the semiconductor chip via an electric wiring formed on the motherboard 100. Also, while one communication module 1 is shown in FIG. 1, a plurality of communication modules that are identical to the communication module 1 are practically arranged in periphery of the semiconductor chip, and each of the communication modules is connected to the motherboard 100 via the communication module connector. In the following description, the communication module connector 2 is abbreviated as a "connector 2".

Figure 2:
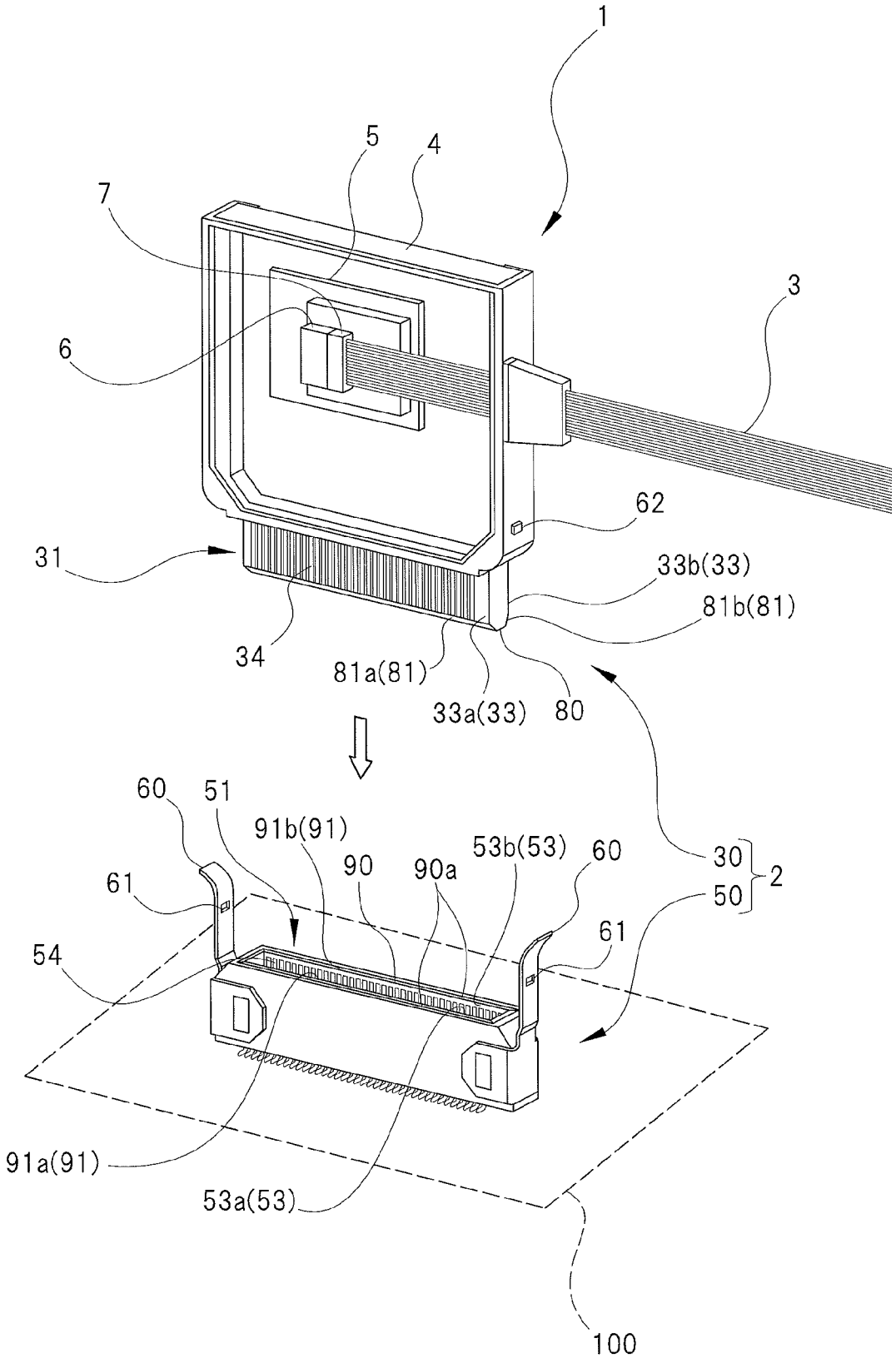
FIG. 2 is a perspective view showing structures of a communication module and a connector shown in FIG. 1.

As shown in FIG. 2, the connector 2 for connecting the communication module 1 and the motherboard 100 is configured of a plug connector 30 provided to the communication module 1 and a receptacle connector 50 provided to the motherboard 100. While the plug connector 30 has an insertion convex portion 31, the receptacle connector 50 has an insertion concave portion 51. The insertion convex portion 31 of the plug connector 30 is inserted into the insertion concave portion 51 of the receptacle connector 50 along an arrow direction (inserting direction) in the drawing. When the insertion convex portion 31 is inserted into the insertion concave portion 51, connector terminals provided to both portions are in contact with each other. In this manner, the communication module 1 and the motherboard 100 are electrically connected to each other via the connector 2, so that signals can be transmitted and received (inputted and outputted) between the communication module 1 and the semiconductor chip mounted on the motherboard 100. Details of the plug connector 30 and the receptacle connector 50 will be described later.

Here, as another method for achieving the small size and the low cost of the connector, there is a method of directly inserting an edge connector provided to the module substrate into the receptacle connector on the motherboard with excluding the plug connector. However, in this method, it is difficult to enhance reliability of the electrical connection between the module substrate and the receptacle connector.

As shown in FIG. 2, the communication module 1 includes: a casing 4 to which an optical fiber (fiber ribbon) 3 is connected; and a module substrate 5 housed in the casing 4. Although not shown, a photoelectric converting unit is provided to the module substrate 5. Specifically, on the module substrate 5, a light-emitting element, a driving IC which drives the light-emitting element, a light-receiving element, and an amplifying IC which amplifies a signal outputted from the light-receiving element are mounted. Also, the module substrate 5 is provided with a lens block 6 which optically couples the light-emitting element and the light-receiving element with the optical fiber 3. A MT (Mechanically Transferable) connector 7 is attached to a distal end of the optical fiber 3 drawn into the casing 4, and this MT connector 7 is connected to the lens block 6. Specifically, a distal-end surface of the MT connector 7 abuts on an abutting surface of the lens block 6. Furthermore, paired guide pins protruding from the abutting surface of the lens block 6, and these guide pins are inserted into a guide hole formed at the distal-end surface of the MT connector 7. In the present embodiment, note that a VCSEL (Vertical Cavity Surface Emitting Laser) is used as the light-emitting element, and a PD (Photodiode) is used as the light-receiving element. However, the light-emitting element and the light-receiving element are not limited to specific light-emitting element and light-receiving element.

As shown in FIG. 2, the plug connector 30 has a block-shaped insertion convex portion 31 and a plate-shaped flange portion 32 (FIG. 4B and FIG. 4C) provided on an upper part of the insertion convex portion 31, and the flange portion 32 spreads in periphery of the insertion convex portion 31. In other words, the insertion convex portion 31 extends downward from the flange portion 32, and the insertion convex portion 31 and the flange portion 32 are integrally formed of a dielectric body (synthetic resin in the present embodiment).

As shown in FIG. 2, the insertion convex portion 31 has an end surface 80 and two outer side surfaces 33*a* and 33*b* facing each other in parallel across the end surface 80. Furthermore, the insertion convex portion 31 has a first tapered surface 81*a* connecting one outer side surface 33*a* and the end surface 80 and a first tapered surface 81*b* connecting the other outer side surface 33*b* and the end surface 80.

In the following description, the outer side surface 33*a* of the insertion convex portion 31 is referred to as a "right outer side surface 33*a*", and the outer side surface 33*b* thereof is referred to as a "left outer side surface 33*b*". Also, in some cases, the first tapered surface 81*a* connecting the right outer side surface 33*a* and the end surface 80 is referred to as a "right-side first tapered surface 81*a*", and the first tapered surface 81*b* connecting the left outer side surface 33*b* and the end surface 80 is referred to as a "left-side first tapered surface 81*b*".

On the other hand, in some cases, the right outer side surface 33*a* and the left outer side surface 33*b* are collectively referred to as an "outer side surface 33", and the right-side first tapered surface 81*a* and the left-side first tapered surface 81*b* are collectively referred to as a "first tapered surface 81".

The receptacle connector 50 shown in FIG. 2 is molded by using a dielectric body (synthetic resin in the present embodiment), and has the insertion concave portion 51 into which the insertion convex portion 31 of the plug connector 30 is inserted. The insertion concave portion 51 has an insertion port 90, a bottom portion 52 facing the insertion port 90 (FIG. 5A), and inner side surfaces 53*a* and 53*b* standing up from an inner surface of the bottom portion. The inner side surfaces 53*a* and 53*b* stand up from two facing long sides of the inner surface of the bottom portion, respectively. In other words, two inner side surfaces 53*a* and 53*b* are parallel to each other, and face each other across the bottom portion 52 and the insertion port 90. Furthermore, one inner side surface 53*a* and an edge 90*a* of the insertion port 90 are connected to each other by a second tapered surface 91*a*, and the other inner side surface 53*b* and the edge 90*a* of the insertion port 90 are connected to each other by a second tapered surface 91*b*.

In the following description, in some cases, the inner side surface 53*a* of the insertion concave portion 51 is referred to as a "right inner side surface 53*a*", and the inner side surface 53*b* is referred to as a "left inner side surface 53*b*". Also, in some cases, the second tapered surface 91*a* connecting the right inner side surface 53*a* and the edge 90*a* of the insertion port 90 is referred to as a "right-side second tapered surface 91*a*", and the second tapered surface 91*b* connecting the left inner side surface 53*b* and the edge 90*a* of the insertion port 90 is referred to as a "left-side second tapered surface 91*b*".

Figure 3:
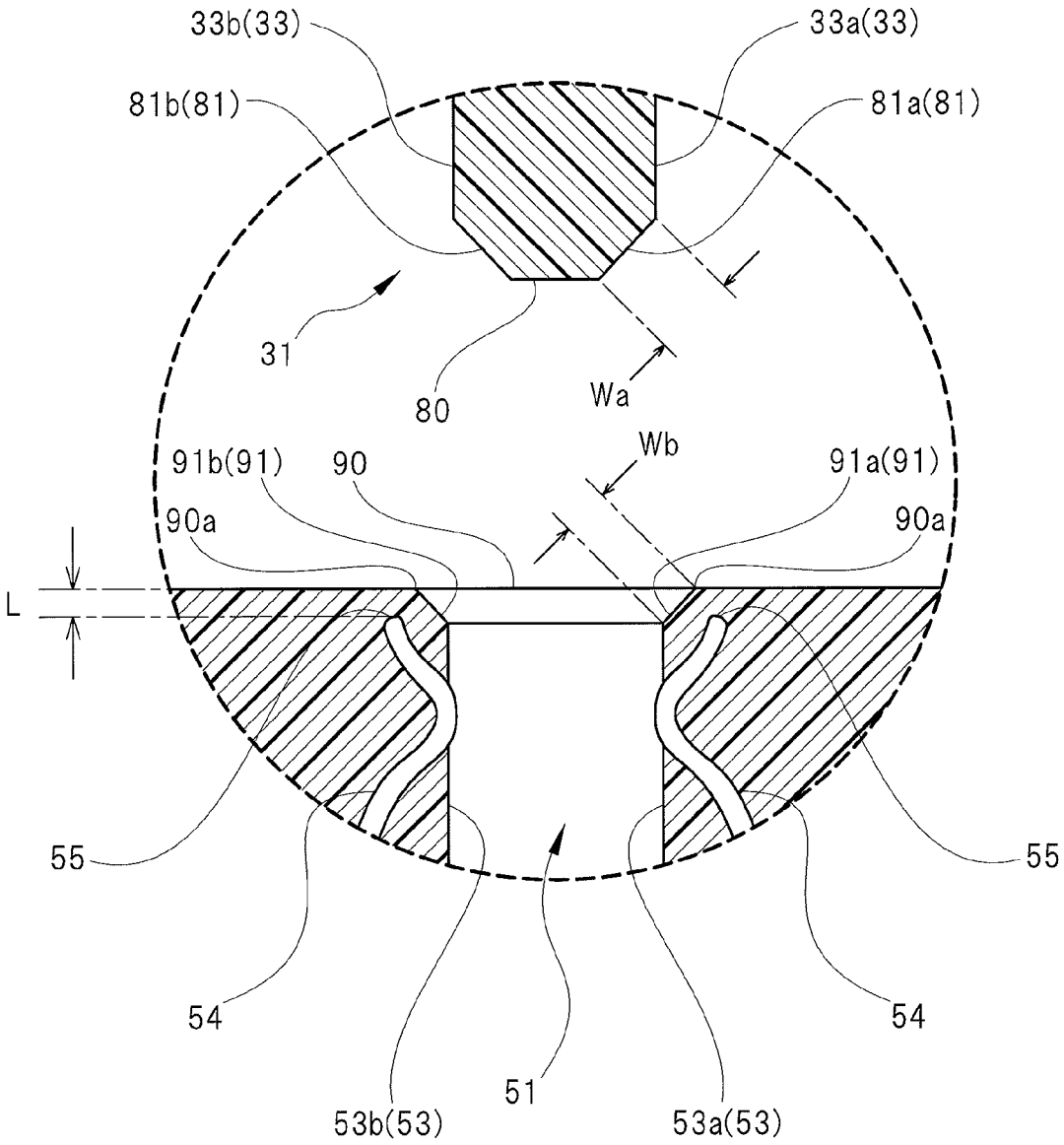
FIG. 3 is a partially-enlarged cross-sectional view of an insertion convex portion and an insertion concave portion.

On the other hand, in some cases, the right inner side surface 53*a* and the left inner side surface 53*b* are collectively referred to as an "inner side surface 53", and the right-side second tapered surface 91*a* and the left-side second tapered surface 91*b* are collectively referred to as a "second tapered surface 91". As shown in FIG. 3, a width (Wa) of the first tapered surface 81 is twice as large as a width (Wb) of the second tapered surface 91 or larger. Here, the width (Wa) of the first tapered surface 81 means a distance along the first tapered surface 81 from a connection side between the outer side surface 33 and the first tapered surface 81 to a connection side between the end surface 80 and the first tapered surface 81. On the other hand, the width (Wb) of the second tapered surface 91 means a distance along the second tapered surface 91 from a connection side between the edge 90*a* of the insertion port 90 and the second tapered surface 91 to a connection side between the inner side surface 53 and the second tapered surface 91.

In other words, the right-side first tapered surface 81*a* and the right outer side surface 33*a* have one common side (long side). Also, the right-side first tapered surface 81*a* and the end surface 80 have one common side (long side). Therefore, the width (Wa) of the right-side first tapered surface 81*a* means a distance along the right-side first tapered surface 81*a* between the two long sides. On the other hand, the left-side first tapered surface 81*b* and the left outer side surface 33*b* have one common side (long side). Also, the left-side first tapered surface 81*b* and the end surface 80 have one common side (long side). Therefore, the width (Wa) of the left-side first tapered surface 81*b* means a distance along the left-side first tapered surface 81*b* between the two long sides.

Furthermore, the right-side second tapered surface 91*a* and the right inner side surface 53*a* have one common side (long side). Also, the right-side second tapered surface 91*a* and the insertion port 90 have one common side (long side). Therefore, the width (Wb) of the right-side second tapered surface 91*a* means a distance along the right-side second tapered surface 91*a* between the two long sides. On the other hand, the left-side second tapered surface 91*b* and the left inner side surface 53*b* have one common side (long side). Also, the left-side second tapered surface 91*b* and the insertion port 90 have one common side (long side). Therefore, the width (Wb) of the left-side second tapered surface 91*b* means a distance along the left-side second tapered surface 91*b* between the two long sides.

Figure 4A:
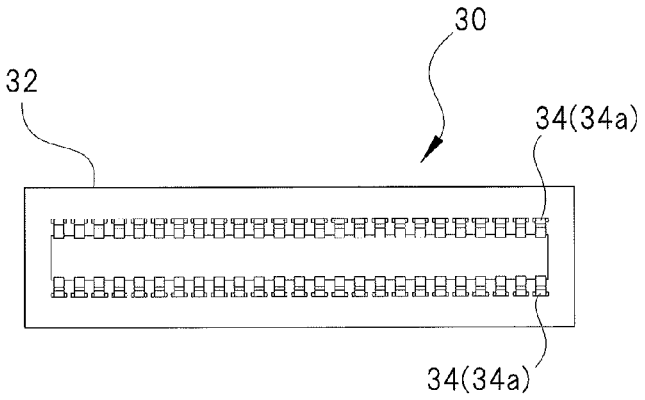
FIG. 4A is a plan view of the plug connector.
Figure 4B:
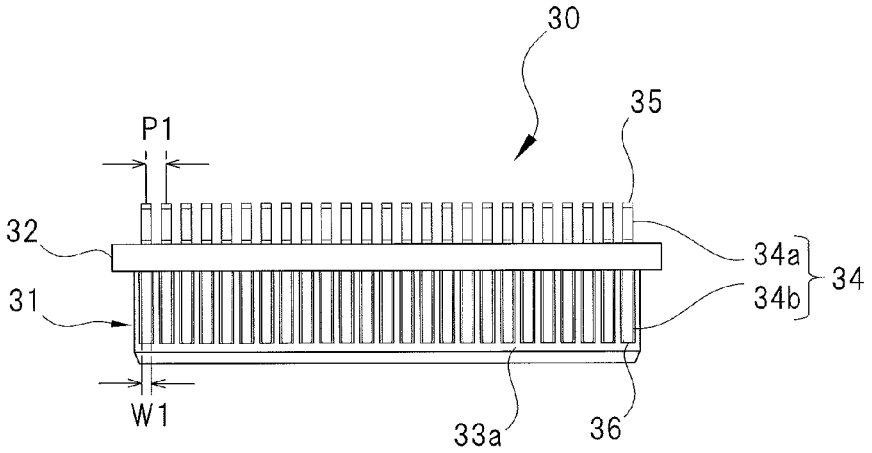
FIG. 4B is a front view of the plug connector.
Figure 4C:
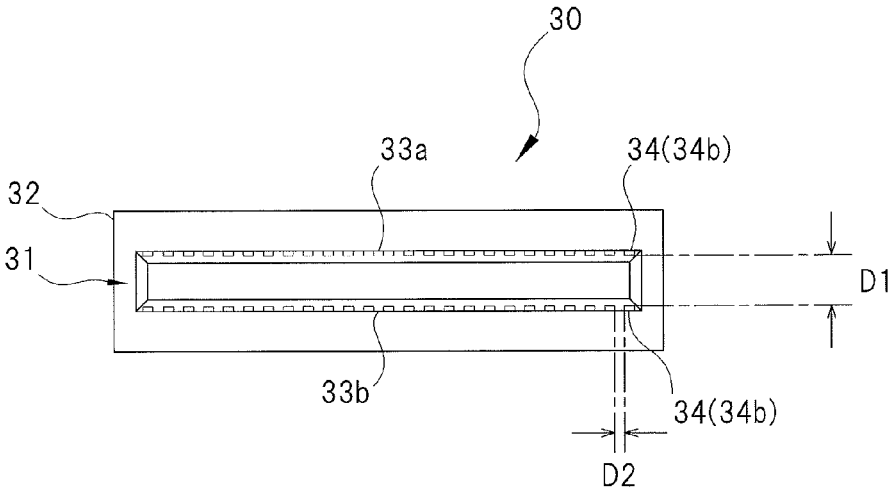
FIG. 4C is a bottom view of the plug connector.

As shown in FIG. 4B and FIG. 4C, a plurality of first connection terminals 34 are arranged in parallel to each other on the right outer side surface 33*a* and the left outer side surface 33*b* of the insertion convex portion 31 along longitudinal directions of these outer side surfaces 33*a* and 33*b*. In other words, a terminal row formed of the plurality of first connection terminals 34 is formed on each of the right outer side surface 33*a* and the left outer side surface 33*b* of the insertion convex portion 31. In the following description, in some cases, a terminal row formed on the right outer side surface 33*a* shown in FIG. 4C is referred to as a "right-side first terminal row", and a terminal row formed on the left outer side surface 33*b* is referred to as a "left-side first terminal row".

As shown in FIG. 4B, each of the first connection terminals 34 forming the right-side first terminal row and the left-side first terminal row extends along a direction of inserting the insertion convex portion 31 into the insertion concave portion 51 (an arrow direction in FIG. 2), and reaches upper and lower portions of the flange portion 32 across the flange portion 32. In the following description, when an "inserting direction" is described, the inserting direction means a direction of inserting the insertion convex portion 31 into the insertion concave portion 51 (the arrow direction in FIG. 2) unless otherwise specified.

While a part of each first connection terminal 34 in the longitudinal direction, the terminal extending along the inserting direction, protrudes upward from the flange portion 32, the other part of each first connection terminal 34 in the longitudinal direction protrudes downward from the flange portion 32. Therefore, while an upper-side end portion 35 of the first connection terminal 34 in the inserting direction is positioned above the flange portion 32, a lower-side end portion 36 of the first connection terminal 34 in the inserting direction is positioned below the flange portion 32. In some in cases in the following description, a part of the first connection terminal 34 in the longitudinal direction protruding upward from the flange portion 32 is referred to as an "upper portion 34*a*", and the other part of the first connection terminal 34 protruding in the longitudinal direction downward from the flange portion 32 is referred to as a "lower portion 34*b*".

Figure 6:
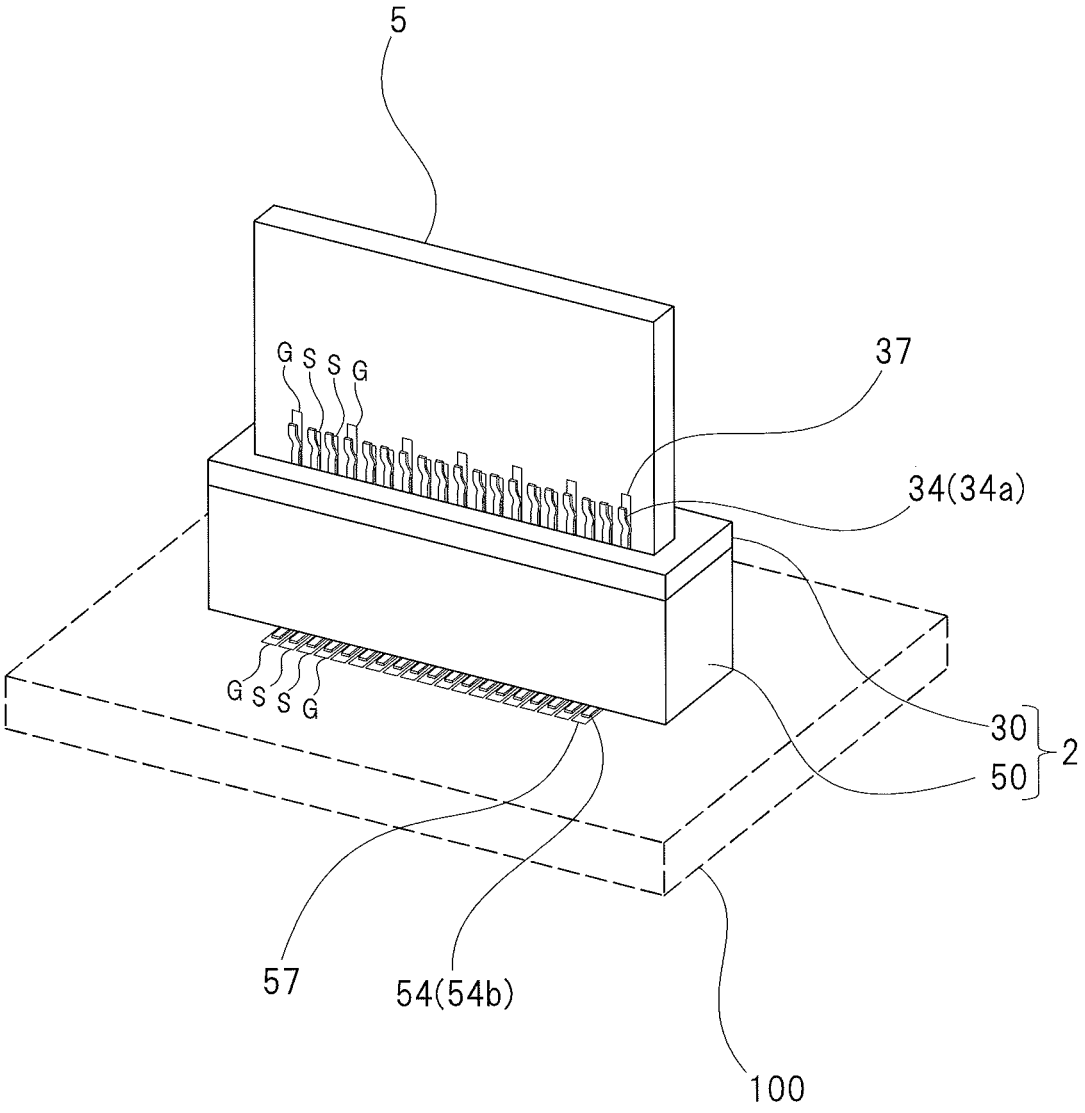
FIG. 6 is a perspective view schematically showing a connection state between the plug connector and the receptacle connector.

As shown in FIG. 4A, the upper portion 34*a* of each first connection terminal 34 configuring the right-side first terminal row and the upper portion 34*a* of each first connection terminal 34 configuring the left-side first terminal row face each other with a predetermined distance to form a pair. As shown in FIG. 6, the edge of the module substrate 5 is inserted into the space between the upper portion 34*a* of the right-side first terminal row and the upper portion 34*a* of the left-side first terminal row (FIG. 4A). On each of both surfaces of the edge of the module substrate 5, a connection pad 37 is formed, and a predetermined connection pad 37 and the upper portion 34*a* of a predetermined first connection terminal 34 make contact with each other for electrical conduction. Note that the space between the upper portion 34*a* of the right-side first terminal row and the upper portion 34*a* of the left-side first terminal row is slightly narrower than the thickness of the module substrate 5. Therefore, when the edge of the module substrate 5 is inserted into the space between the upper portion 34*a* of the right-side first terminal row and the upper portion 34*a* of the left-side first terminal row, the upper portion 34*a* of the right-side first terminal row and the upper portion 34*a* of the left-side first terminal row are elastically deformed so as to be spaced apart from each other. As a result, the upper portion 34*a* of the right-side first terminal row and the upper portion 34*a* of the left-side first terminal row are in contact with the connection pad 37 by elastic restoring force. Normally, the upper portion 34*a* of the right-side first terminal row and the upper portion 34*a* of the left-side first terminal row which are in contact with the connection pad 37 as described above are fixed thereto by soldering.

In the present embodiment, a plurality of pad groups each including four connection pads 37 are arranged along one side of the module substrate 5. Two outer connection pads 37 of the four connection pads 37 included in each pad group are used for grounding (G), and two inner connection pads 37 thereof are used for signals (S). In other words, in each pad group, the grounding pad, the signal pad, the signal pad, and the grounding pad are arranged in this order. The first connection terminals 34 in contact with the grounding connection pads 37 of the plurality of first connection terminals 34 are grounded, and differential signals are inputted to and outputted from the first connection terminals 34 in contact with the signal connection pads 37. That is, a pair of the first connection terminals 34 to/from which differential signals are inputted/outputted are sandwiched by the other pair of the grounded first connection terminals 34. Obviously, the description regarding the terminal arrangement is for not arrangement of low-speed signal (for example, control signal) terminals or power supply terminals but arrangement of high-speed signal terminals.

Figure 5A:
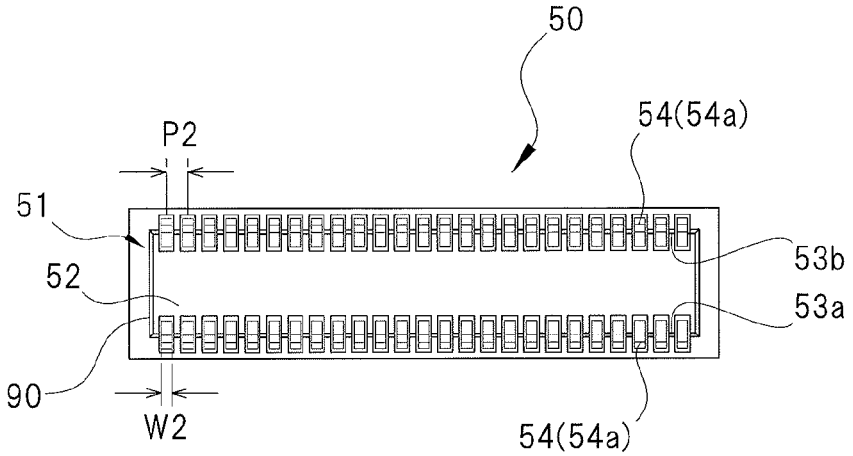
FIG. 5A is a plan view of the receptacle connector.
Figure 5B:
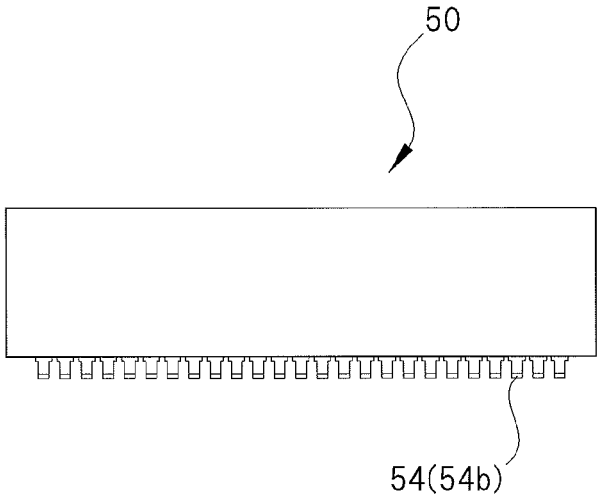
FIG. 5B is a front view of the receptacle connector.
Figure 5C:
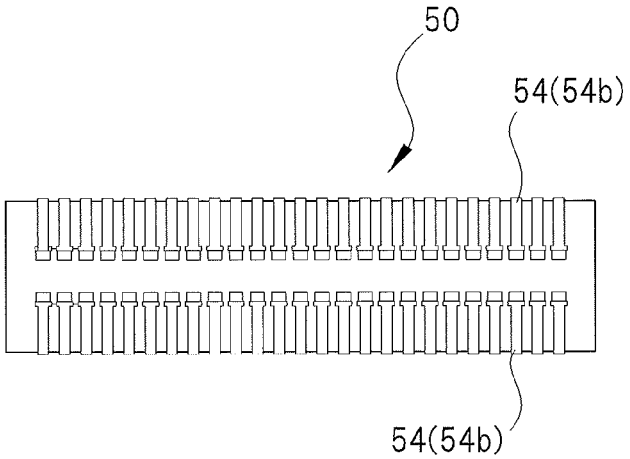
FIG. 5C is a bottom view of the receptacle connector.

As shown in FIG. 5A to FIG. 5C, a plurality of second connection terminals 54 are arranged in parallel to each other on the right inner side surface 53*a* and the left inner side surface 53*b* of the insertion concave portion 51 along a longitudinal direction of these inner side surfaces 53*a* and 53*b*. In other words, a terminal row formed of the plurality of second connection terminals 54 is formed on each of the right inner side surface 53*a* and the left inner side surface 53*b* of the insertion concave portion 51. In some cases in the following description, a terminal row formed on the right inner side surface 53*a* shown in FIG. 5A is referred to as a "right-side second terminal row", and a terminal row formed on the left inner side surface 53*b* is referred to as a "left-side second terminal row".

The second connection terminals 54 each of which forms the right-side second terminal row and the left-side second terminal row extends along the inserting direction, and penetrates through the bottom portion 52 so as to reach upper and lower portions of the bottom portion 52. That is, while a part of the second connection terminal 54 in the longitudinal direction protrudes upward from the bottom portion 52 (inward from the insertion concave portion 51), the other part of the second connection terminal 54 in the longitudinal direction protrudes downward from the bottom portion 52 (outward from the insertion concave portion 51). Thus, in some cases in the following description, the part of the second connection terminal 54 protruding upward from the bottom portion 52 is referred to as an "upper portion 54*a*", and the other part of the second connection terminal 54 protruding downward from the bottom portion 52 is referred to a "lower portion 54*b*".

As shown in FIG. 5A, the upper portion 54*a* of each second connection terminal 54 configuring the right-side second terminal row and the upper portion 54*a* of each second connection terminal 54 configuring the left-side second terminal row face each other to form a pair. On the other hand, as shown in FIG. 5C, the lower portion 54*b* of each second connection terminal 54 is bent outward at about 90 degrees, and extends along the outer surface of the bottom portion.

As shown in FIG. 6, a plurality of connection pads 57 are formed on the motherboard 100, and the lower portion 54*b* of each second connection terminal 54 which is bent as described above is soldered and overlapped on a predetermined connection pad 57.

In the present embodiment, a plurality of pad groups each including four connection pads 57 are linearly arranged on the motherboard 100. Two outer connection pads 57 of the four connection pads 57 included in each pad group are used for grounding (G), and two inner connection pads 57 thereof are used for signals (S). In other words, in each pad group, the grounding pad, the signal pad, the signal pad, and the grounding pad are arranged in this order. The second connection terminals 54 of the plurality of second connection terminals 54, which are soldered on the grounding connection pads 57, are grounded, and differential signals are inputted to and outputted from the second connection terminals 54 soldered on the signal connection pads 57. That is, a pair of the second connection terminals 54 which differential signals are inputted to and outputted from is interposed to the other pair of the grounded second connection terminals 54.

Figure 7:
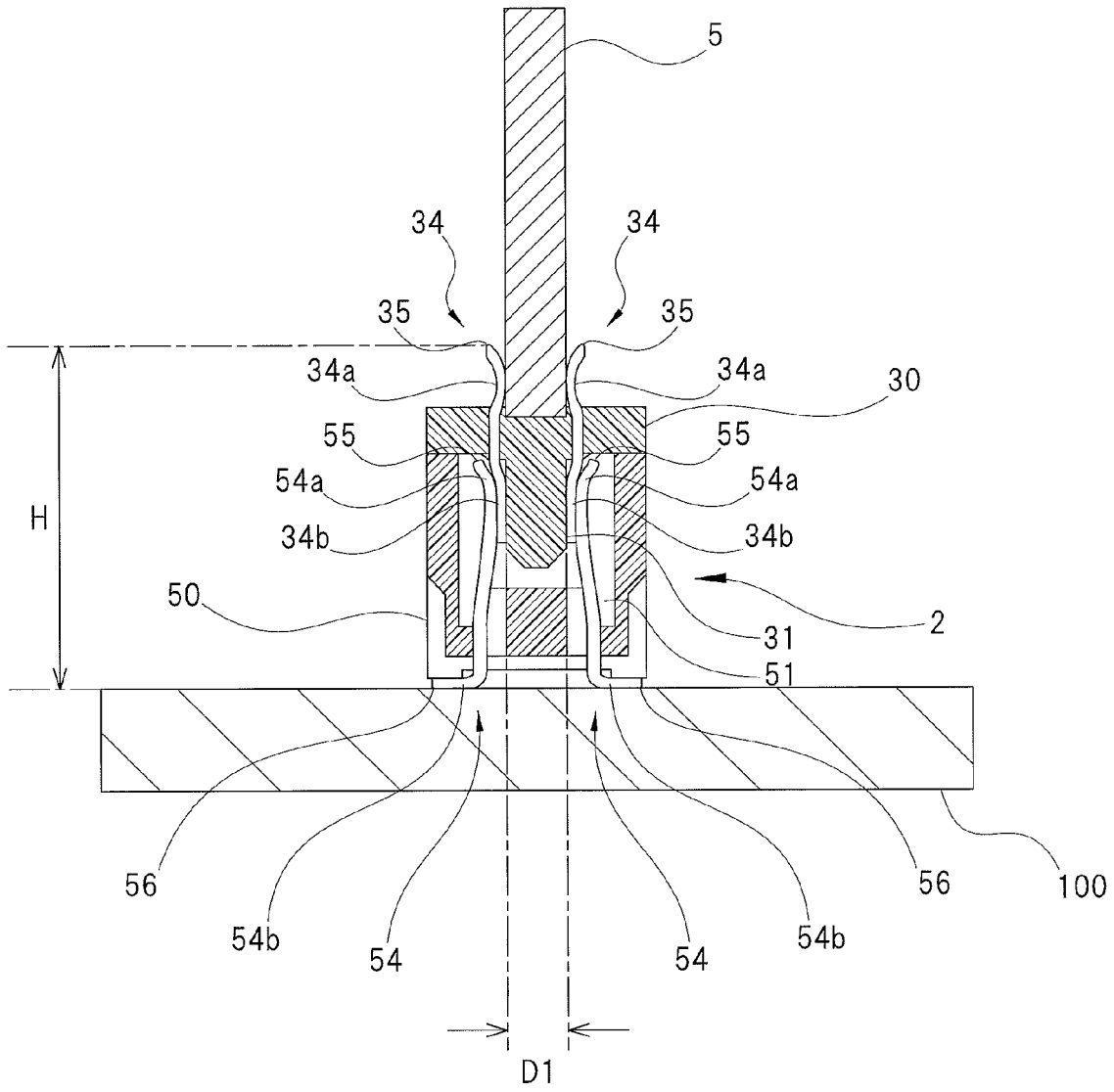
FIG. 7 is an enlarged cross-sectional view showing the connection state between the plug connector and the receptacle connector.

As shown in FIG. 6, when the plug connector 30 is connected to the receptacle connector 50, a predetermined connection pad 37 on the module substrate 5 and a predetermined connection pad 57 on the motherboard 100 are connected to each other via the first connection terminal 34 and the second connection terminal 54. Specifically, as shown in FIG. 7, when the insertion convex portion 31 of the plug connector 30 is inserted into the insertion concave portion 51 of the receptacle connector 50, the right-side first terminal row and the left-side first terminal row provided to the outer side surfaces 33*a* and 33*b* (FIG. 4C) of the insertion convex portion 31 are inserted between the right-side second terminal row and the left-side second terminal row provided to the inner side surfaces 53*a* and 53*b* (FIG. 5A) of the insertion concave portion 51. More specifically, the lower portions 34*b*, 34*b* of the paired first connection terminals 34, 34 are inserted between the facing upper portions 54*a*, 54*a* of the second connection terminals 54, 54. Then, the facing second connection terminals 54, 54 are elastically deformed so that the respective upper portions 54*a*, 54*a* are spaced apart from each other. As a result, by elastic restoring force, the upper portions 54*a*, 54*a* of the second connection terminals 54, 54 respectively are in contact with the lower portions 34*b*, 34*b* of the corresponding first connection terminals 34, 34. By this structure, the first connection terminals 34 and the second connection terminals 35 are electrically connected to each other with high reliability.

That is, the connection pads 37 (FIG. 6) on the module substrate 5 and the connection pads 57 (FIG. 6) on the motherboard 100 are connected to each other via the first connection terminals 34 and the second connection terminals 54. In other words, a signal transmission path including the connector 2 (the first connection terminals 34 and the second connection terminals 54) is formed between the photoelectric converting unit on the module substrate 5 and the semiconductor chip on the motherboard 100. That is, a part of the signal transmission path between the photoelectric converting unit on the module substrate 5 and the semiconductor chip on the motherboard 100 is formed of the connector 2 (the first connection terminals 34 and the second connection terminals 54).

The plug connector 30 connected to (inserted into) the receptacle connector 50 as described above is fixed by clips 60 shown in FIG. 1 to the receptacle connector 50. As shown in FIG. 2, the paired clips 60 formed of sheet metal are mounted on both sides of the receptacle connector 50 in a width direction, and an engaging hole 61 is formed in each clip 60. On the other hand, an engaging protrusion portion 62 is formed on each of both side surfaces of the casing 4 of the communication module 1. When the plug connector 30 is connected to the receptacle connector 50, that is, when an insertion length of the insertion convex portion 31 into the insertion concave portion 51 reaches a predetermined length, the engaging protrusion portion 62 is fitted to the engaging hole 61 as shown in FIG. 1. In this manner, the communication module 1 provided with the plug connector 30 and the receptacle connector 50 are fixed to each other. Note that the sheet-metal-made clips 60 are elastically deformable. Therefore, when two clips 60, 60 are widened outward so as to be spaced apart from each other, the fitting between the engaging hole 61 and the engaging protrusion portion 62 is released, and the fixing between the communication module 1 and the receptacle connector 50 is also released.

Here, the second connection terminal 54 provided to the receptacle connector 50 has a straight shape. The straight shape means a shape having an upper-side end portion 55 in the inserting direction positioned higher than any other portion in the same direction as each other and not having a portion positioned at the same height in the inserting direction as shown in FIG. 7. For example, even if one end portion of the connection terminal in the inserting direction is at the highest position in the same direction, the connection terminal does not have the straight shape when the connection terminal has two or more portions at the same height in the inserting direction thereon because the connection terminal is curved or bent.

In a state in which the plug connector 30 and the receptacle connector 50 are connected to each other, it is preferred that a direct distance along the inserting direction from the lower-side end portion 56 of the second connection terminal 54 in the inserting direction which has the straight shape to the upper-side end portion 35 of the first connection terminal 34 in the inserting direction in contact with the second connection terminal 54 is 6.0 mm or smaller. In other words, it is preferred that a height (H) from the lower-side end portion 56 of the second connection terminal 54 in the inserting direction to the upper-side end portion 35 of the first connection terminal in the inserting direction is 6.0 mm or smaller, and is 5.4 mm in the present embodiment.

As described above, a part of the signal transmission path between the photoelectric converting unit on the module substrate 5 and the semiconductor chip on the motherboard 100 is formed of the connector 2 (the first connection terminals 34 and the second connection terminals 54). However, a part of the signal transmission path formed of the connector 2 has poorer transmission characteristics than that of another part of signal transmission paths formed of wiring layers on the module substrate 5 and the motherboard 100. For example, at a part (hereinafter a "connector portion") of the signal transmission path which is formed of the connector 2, it is difficult to completely match a characteristic impedance, and therefore, reflection tends to occur. Therefore, in view of suppressing signal degradation and improve transmission characteristics, it is preferred to shorten the length of the connector portion occupying the signal transmission path as much as possible. Specifically, it is preferred to set the length of the connector portion occupying the signal transmission path as a length within about one several-th of the wavelength of a signal propagating through the signal transmission path. For example, a fundamental wave of a high-speed signal of 25 Gbit/sec has a frequency of 12.5 GHz and a wavelength of 24.0 mm. On the other hand, in the present embodiment, the height (H) shown in FIG. 7 is 6.0 mm. And, the height (H) shown in FIG. 7 is a distance (height) from the lower-side end portion 56 of the second connection terminal 54 in the inserting direction to the upper-side end portion 35 of the first connection terminal 34 in the inserting direction in contact with the second connection terminal 54. That is, in the present embodiment, the length of the connector portion occupying the signal transmission path between the photoelectric converting unit on the module substrate 5 and the semiconductor chip on the motherboard 100 is set at ¼ of the signal wavelength (24.0 mm). Note that the signal wavelength is a signal wavelength in a vacuum, and an actual signal wavelength (inside the connector 2) is about ½ of the above-described numerical value. This is because, as expressed in the following formula, a signal transmission speed (C1) on the transmission path is determined by a relative permittivity "∈" of a dielectric material which is a material of the connector 2 (crystal polymer generally used as the material of the connector has a relative permittivity (∈) of about 4.0), and because a signal wavelength (λ) thereof is determined by the signal propagation speed (C1).

$$C1=C/(\sqrt{\in})$$

C: light speed (about 30 ten thousands (three hundred thousands) Km/sec), ∈: relative permittivity $$C1=f\lambda,$$

f: frequency, λ: signal wavelength

Therefore, even if the signal wavelength in vacuum is 24.0 mm, the actual signal wavelength when propagating through the first connection terminal 34 and the second connection terminal 54 shown in FIG. 7 is about 12.0 mm. That is, the height (H) shown in FIG. 7 is set at ¼ in relation to the signal wavelength in vacuum and is set at ½ in relation to the actual signal wavelength.

Absolutely, a multiple structure formed of the dielectric body and air (a relative permittivity about equal to that of the vacuum) is provided inside the connector 2. Therefore, the above description is for general outlines of the idea, and an effective relative permittivity (∈) can be considered as being smaller. Either way, in the present embodiment, the length of the connector portion occupying the signal transmission path is set at a length of about one several-th of the wavelength of the signal propagating through the signal transmission path, so that the signal degradation is reduced.

FIG. 3 is referred to again. As described above, the width (Wa) of the first tapered surface 81 is twice as large as the width (Wb) of the second tapered surface 91. In other words, the width (Wb) of the second tapered surface 91 is equal to or smaller than ½ of the width (Wa) of the first tapered surface 81. Note that it is preferable that the width (Wa) of the first tapered surface 81 is about 0.3 mm (0.2 mm to 0.4 mm). By narrowing the width of the second tapered surface 91 as described above, a direct distance (L) along the inserting direction from the upper-side end portion 55 of the second connection terminal 54 in the inserting direction to an opening surface of the insertion port 90 is suppressed to be short. Specifically, the direct distance (L) is suppressed to be 0.2 mm or smaller. That is, the insertion port 90 is lowered to about the same height as that of the upper end portion of the second connection terminal 54. As a result, the height of the receptacle connector 50 is lowered, and the height of the entire connector is lowered when the plug connector 30 and the receptacle connector 50 are connected to each other as shown in FIG. 6, so that a mounting space is reduced, and a mounting density is improved. Also, electrical connection with high reliability is achieved, the signal degradation is reduced, and the high-speed signals (25 Gbit/sec or higher) can be transmitted.

Note that the first tapered surface 81 having a sufficient width is provided to the insertion convex portion 31 of the plug connector 30, and therefore, ease of insertion of the insertion convex portion 31 into the insertion concave portion 51 is not degraded compared with the conventional art.

Also, in view of preventing crosstalk of electrical signals, it is preferred that a distance between the right-side first terminal row and the left-side first terminal row is sufficiently wider than a distance between two adjacent first connection terminals 34 in these terminal rows. Regarding this point, in the present embodiment, a distance (D1) between the first connection terminals 34 formed on the right outer side surface 33*a* and the first connection terminals 34 formed on the left outer side surface 33*b* shown in FIG. 4C is 1.0 mm. In other words, the distance between the right-side first terminal row and the left-side first terminal row is 1.0 mm. On the other hand, a distance (D2) between two adjacent first connection terminals 34 in the right-side first terminal row or the left-side first terminal row is 0.25 mm. That is, the distance (D1) is four times as large as the distance (D2) or larger, so that the crosstalk is sufficiently prevented. Note that the distance (D1) can be more clearly understood with reference to FIG. 7. That is, the distance between the paired first connection terminals 34, 34 facing across the insertion convex portion 31 and the distance between the paired second connection terminals 54, 54 change depending on a location (inserting direction) and are not constant. On the other hand, in view of preventing the crosstalk, the minimum distance between the paired facing first connection terminals 34, 34 is most important. As shown in FIG. 7, the distance (D1) corresponds to the minimum distance between the paired first connection terminals 34, 34 facing each other across the insertion convex portion 31.

Obviously, the distance (D2) shown in FIG. 4C is not limited to 0.25 mm. For example, the distance (D2) can be changed as appropriately within a range of 0.20 mm or larger and 0.30 mm or smaller, and the distance (D1) can also be changed appropriately in accordance with the change of the distance (D2).

Furthermore, it is preferred that an arrangement pitch (P1) of the first connection terminals 34 shown in FIG. 4B is 0.45 mm or larger and 0.55 mm or smaller, and is 0.50 mm in the present embodiment. Similarly, it is preferred that an arrangement pitch (P2) of the second connection terminals 54 shown in FIG. 5A is 0.45 mm or larger and 0.55 mm or smaller, and is 0.50 mm in the present embodiment. Note that the arrangement pitch is a distance between the centers of the adjacent connection terminals.

Still further, it is preferred that the width (W1) of the first connection terminal 34 shown in FIG. 4B and the width (W2) of the second connection terminal 54 shown in FIG. 5A are 0.15 mm or larger and 0.30 mm or smaller.

The numerical values regarding the arrangement pitches, the distance between the connection terminals, and the width of the connection terminals are numerical values suitable for particularly achieving the transmission speed of 25 Gbit/sec or higher, a desired number of channels, highly-accurate impedance control, reduction in the manufacturing cost, etc.

Note that an effective fit length between the plug connector 30 and the receptacle connector 50 in the present embodiment is about 0.7 mm.

The present invention having the features described above is applicable to not only an optical communication module and an optical connector but also an electrical communication module and an electrical connector. Particularly, the present invention is suitable for application to an electrical communication module and an electrical connector used for a supercomputer, a data center, or others, for which extremely high reliability and high speed characteristics are required. Note that, when the present invention is applied to the electrical communication module or the electrical connector, the optical fiber 3 shown in FIG. 1, FIG. 2, and others is replaced by a cable for electrical signal transmission.

The present invention is not limited to the foregoing embodiments and various modifications and alterations can be made within the scope of the present invention. For example, the second tapered surface 19 shown in FIG. 2, FIG. 3, and others is an intentionally-formed tapered surface. However, a tapered surface which is unintentionally formed as a result of manufacture is also included in the second tapered surface as long as the conditions described in the claims are satisfied.

What is claimed is:

1. A communication module connector comprising a plug connector and a receptacle connector into which the plug connector is inserted, wherein the plug connector has an insertion convex portion including: an end surface; two outer side surfaces facing in parallel to each other across the end surface; and a first tapered surface connecting each of the outer side surfaces and the end surface, the receptacle connector has an insertion concave portion into which the insertion convex portion is inserted, the insertion concave portion including: an insertion port; two inner side surfaces facing in parallel to each other across the insertion port; and a second tapered surface connecting each of the inner side surfaces and an edge of the insertion port, each of the outer side surfaces of the insertion convex portion has a plurality of first connection terminals arranged in parallel to each other along longitudinal directions of these outer side surfaces, each of the inner side surfaces of the insertion concave portion has a plurality of second connection terminals arranged in parallel to each other in contact with the first connection terminals and, and the first tapered surface has a width which is twice as large as a width of the second tapered surface or larger, the first connection terminals and the second connection terminals extend along an inserting direction of the insertion convex portion into the insertion concave portion, and a direct distance along the inserting direction from an upper-side end portion of the second connection terminal in the inserting direction to an opening surface of the insertion port is equal to or smaller than a direct distance of the inserting-direction component of the width of the second tapered surface.

2. The communication module connector according to claim 1, wherein a direct distance along the inserting direction from an upper-side end portion of the second connection terminal in the inserting direction to an opening surface of the insertion port is 0.2 mm or smaller.

3. The communication module connector according to claim 2, wherein the upper-side end portion of the second connection terminal in the inserting direction is positioned higher than any other portion of the second connection terminal in the same direction, and the second connection terminal does not have a portion positioned at the same height in the inserting direction.

4. A communication module comprising a plug connector connected to a receptacle connector, wherein the plug connector has an insertion convex portion inserted into an insertion concave portion provided to the receptacle connector, the insertion convex portion including: an end surface; two outer side surfaces facing in parallel to each other across the end surface; and a first tapered surface connecting each of the outer side surfaces and the end surface, the insertion concave portion of the receptacle connector includes: an insertion port into which the insertion convex portion is inserted; two inner side surfaces facing in parallel to each other across the insertion port; and a second tapered surface connecting each of the inner side surfaces and an edge of the insertion port, each of the outer side surfaces of the insertion convex portion has a plurality of first connection terminals arranged therein which are connected to a plurality of second connection terminals arranged in the inner side surface of the insertion concave portion, and the first tapered surface has a width which is twice as large as a width of the second tapered surface or larger, the first connection terminals and the second connection terminals extend along an inserting direction of the insertion convex portion into the insertion concave portion, and a direct distance along the inserting direction from an upper-side end portion of the second connection terminal in the inserting direction to an opening surface of the insertion port is equal to or smaller than a direct distance of the inserting-direction component of the width of the second tapered surface.

5. A communication module connector comprising a plug connector and a receptacle connector into which the plug connector is inserted, wherein the plug connector has an insertion convex portion including: an end surface; two outer side surfaces facing in parallel to each other across the end surface; and a first tapered surface connecting each of the outer side surfaces and the end surface, the receptacle connector has an insertion concave portion into which the insertion convex portion is inserted, the insertion concave portion including: an insertion port; two inner side surfaces facing in parallel to each other across the insertion port; and a second tapered surface connecting each of the inner side surfaces and an edge of the insertion port, two outer side surfaces of the insertion convex portion which are in parallel to each other have a plurality of first connection terminals arranged in parallel to each other along longitudinal directions of these outer side surfaces, two inner side surfaces of the insertion concave portion which are in parallel to each other have a plurality of second connection terminals arranged in parallel to each other in contact with the first connection terminals, each of the first connection terminals and the second connection terminals extends along an inserting direction of the insertion convex portion into the insertion concave portion, a direct distance along the inserting direction from an upper-side end portion of the second connection terminal in the inserting direction to an opening surface of the insertion port is equal to or smaller than a direct distance of the inserting-direction component of the width of the second tapered surface, an upper-side end portion of the second connection terminal in the inserting direction is positioned higher than any other portion of the second connection terminal in the same direction, and the second connection terminal does not have a portion positioned at the same height in the inserting direction, and, in a state in which the plug connector and the receptacle connector are connected to each other, a direct distance along the inserting direction from a lower-side end portion of the second connection terminal in the inserting direction to an upper-side end portion of the first connection terminal in the inserting direction in contact with the second connection terminal is 6.0 mm or smaller.

6. The communication module connector according to claim 5, wherein a distance between a right-side first terminal row formed of a plurality of the first connection terminals arranged on one of the outer side surfaces of the insertion convex portion and a left-side first terminal row formed of a plurality of the first connection terminals arranged on the other of the outer side surfaces of the insertion convex portion is four times as large as or larger than a distance between adjacent two of the first connection terminals in the right-side first terminal row or the left-side first terminal row.

7. The communication module connector according to claim 5, wherein each of an arrangement pitch of the first connection terminals and an arrangement pitch of the second connection terminals is 0.45 mm or larger and 0.55 mm or smaller.

8. The communication module connector according to claim 5, wherein a distance between adjacent two of the first connection terminals is 0.20 mm or larger and 0.30 mm or smaller, and the first connection terminals and the second connection terminals each have a width of 0.15 mm or larger and 0.30 mm or smaller.

9. A communication module comprising a plug connector connected to a receptacle connector including: an insertion port; two inner side surfaces facing in parallel to each other across the insertion port; and a second tapered surface connecting each of the inner side surfaces and an edge of the insertion port, wherein the plug connector has an insertion convex portion inserted into an insertion concave portion provided to the receptacle connector, the insertion convex portion including: an end surface; two outer side surfaces facing in parallel to each other across the end surface; and a first tapered surface connecting each of the outer side surfaces and the end surface, two outer side surfaces of the insertion convex portion which are in parallel to each other have a plurality of first connection terminals arranged therein so as to be connected to a plurality of second connection terminals arranged in two inner side surfaces of the insertion concave portion which are in parallel to each other, each of the first connection terminals and the second connection terminals extends along an inserting direction of the insertion convex portion into the insertion concave portion, a direct distance along the inserting direction from an upper-side end portion of the second connection terminal in the inserting direction to an opening surface of the insertion port is equal to or smaller than a direct distance of the inserting-direction component of the width of the second tapered surface, an upper-side end portion of the second connection terminal in the inserting direction is positioned higher than any other portion of the second connection terminal in the same direction, and the second connection terminal does not have a portion positioned at the same height in the inserting direction, and, in a state in which the plug connector and the receptacle connector are connected to each other, a direct distance along the inserting direction from a lower-side end portion of the second connection terminal in the inserting direction to an upper-side end portion of the first connection terminal in the inserting direction in contact with the second connection terminal is 6.0 mm or smaller.

10. The communication module according to claim 9, wherein a distance between a right-side first terminal row formed of a plurality of the first connection terminals arranged in one of the outer side surfaces of the insertion convex portion and a left-side first terminal row formed of a plurality of the first connection terminals arranged in the other of the outer side surfaces of the insertion convex portion is four times as large as or larger than a distance between adjacent two of the first connection terminals in the right-side first terminal row or the left-side first terminal row.

* * * * *